US006807687B2

(12) United States Patent
Marras

(10) Patent No.: US 6,807,687 B2
(45) Date of Patent: Oct. 26, 2004

(54) TOILET SEAT AND COVER SYSTEM

(76) Inventor: Leonardo Salvador Marras, Arenales 1025 3rd "A" Acassuso, Buenos Aires (AR), 1641

( * ) Notice: Subject to any disclaimer, the term of this patent is extended or adjusted under 35 U.S.C. 154(b) by 53 days.

(21) Appl. No.: 10/372,467

(22) Filed: Feb. 21, 2003

(65) Prior Publication Data

US 2004/0045082 A1 Mar. 11, 2004

Related U.S. Application Data

(63) Continuation-in-part of application No. 10/237,294, filed on Sep. 9, 2002.

(51) Int. Cl.[7] ..... A47K 13/10
(52) U.S. Cl. ..... 4/246.1; 4/246.3; 4/246.4
(58) Field of Search ..... 4/246.1–246.5

(56) References Cited

U.S. PATENT DOCUMENTS

| | | | | | |
|---|---|---|---|---|---|
| 1,276,472 | A | * | 8/1918 | Zeen | 4/246.4 |
| 4,150,446 | A | | 4/1979 | Crocker | 4/251 |
| 4,803,741 | A | | 2/1989 | Ellison | 4/251 |
| 4,807,307 | A | * | 2/1989 | Sato et al. | 4/246.4 |
| 5,056,165 | A | | 10/1991 | Wescott, Sr. | 4/249 |
| 5,323,496 | A | | 6/1994 | Blair | 4/246.3 |
| 5,327,589 | A | | 7/1994 | Rice | 4/246.2 |
| 5,339,468 | A | * | 8/1994 | Lin | 4/246.5 |
| 5,404,595 | A | | 4/1995 | Carmel | 4/246.1 |
| 5,437,063 | A | | 8/1995 | Cotham | 4/241 |
| 5,444,877 | A | * | 8/1995 | Kumarasurier | 4/246.1 |
| 5,448,782 | A | | 9/1995 | Ratajac | 4/246.5 |
| 5,487,192 | A | | 1/1996 | Hodges | 4/246.3 |
| 5,488,743 | A | * | 2/1996 | Alfonso | 4/246.1 |
| 5,594,958 | A | * | 1/1997 | Nguyen | 4/246.5 |
| 5,713,084 | A | | 2/1998 | Greco | 4/246.1 |
| 5,806,106 | A | | 9/1998 | Carter et al. | 4/246.1 |
| 6,112,335 | A | | 9/2000 | Gaston | 4/246.1 |
| 6,189,160 | B1 | | 2/2001 | Pettus | 4/264.1 |
| 6,308,347 | B1 | | 10/2001 | King | 4/246.1 |
| 6,615,412 | B1 | * | 9/2003 | Hammond | 4/246.1 |

* cited by examiner

*Primary Examiner*—Gregory L. Huson
*Assistant Examiner*—Khoa D. Huynh
(74) *Attorney, Agent, or Firm*—Robert C. Kain, Jr.; Fleit Kain

(57) ABSTRACT

The self-supportive toilet seat and cover system for lifting and placing a toilet seat and cover on an open end of a toilet bowl includes a hinge attached to one end of the toilet bowl opening which also attaches to an end of the toilet seat and toilet cover. The system also includes primary seat and cover levers located on one side of the toilet bowl which are coupled to a fulcrum located below the toilet bowl. The primary levers are also coupled to respective secondary seat and cover levers which are in turn coupled to respective seat and cover collars attached to the ends of the hinge assembly pertaining to the rotational movement of the seat and cover, respectively. Downward pivotal movement of the primary levers causes the toilet cover and seat to swing from a substantially horizontal position to a substantially vertical position.

9 Claims, 9 Drawing Sheets

FIG.6C
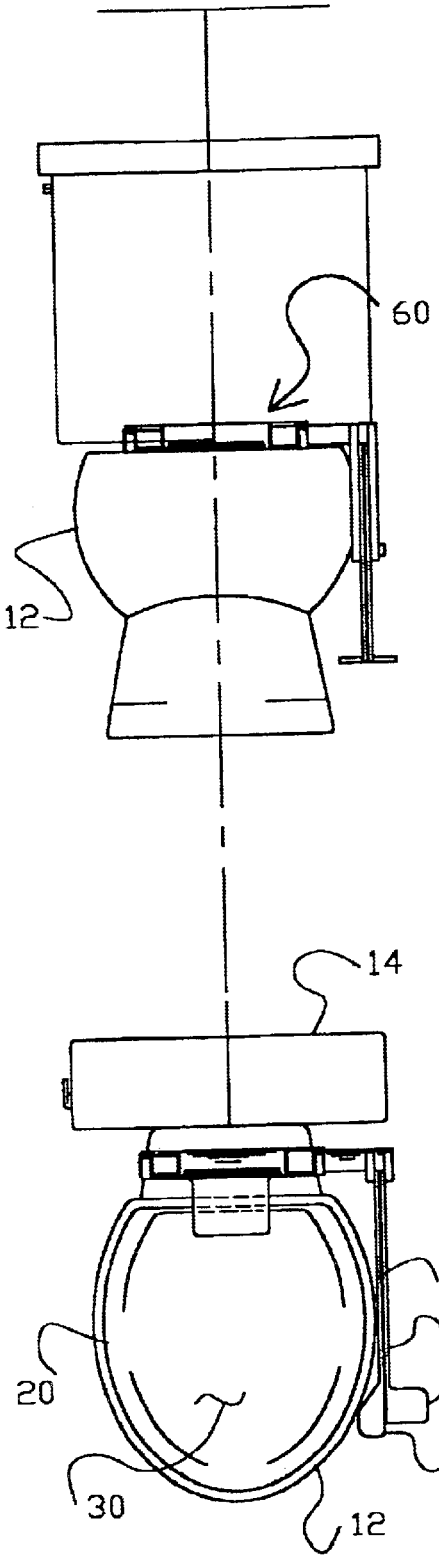
FIG.6A
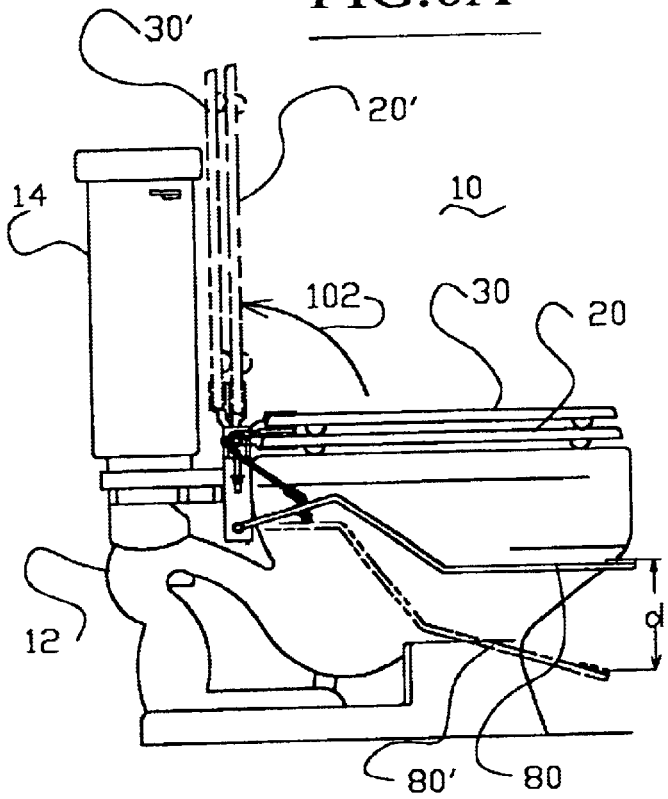
FIG.6B
10

FIG.9A
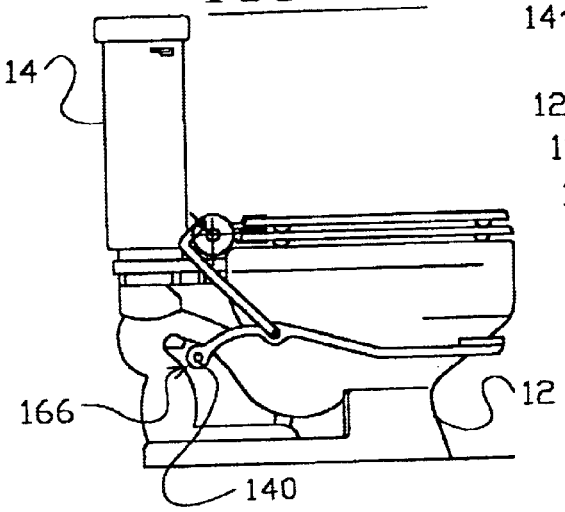
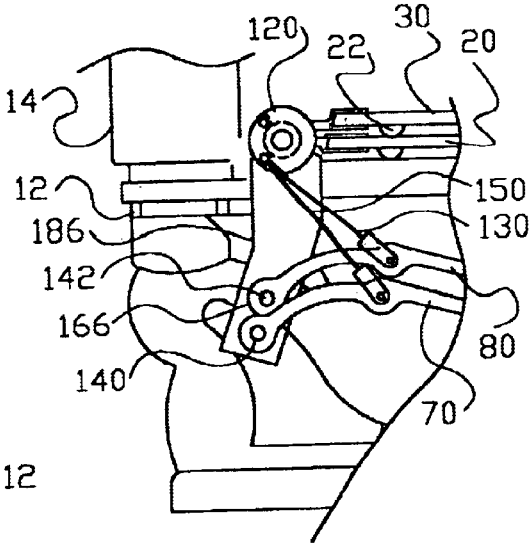
FIG.10
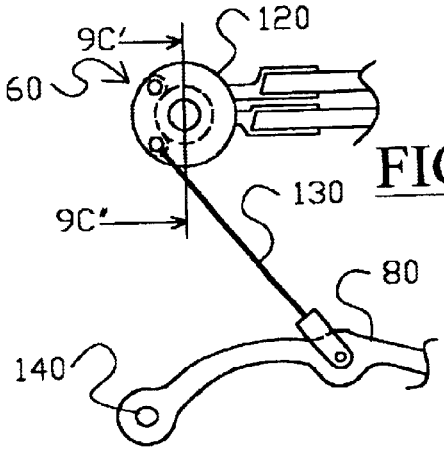
FIG.9B
FIG.11
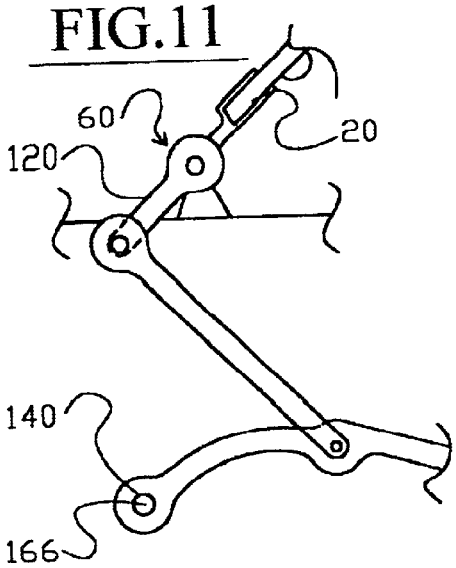
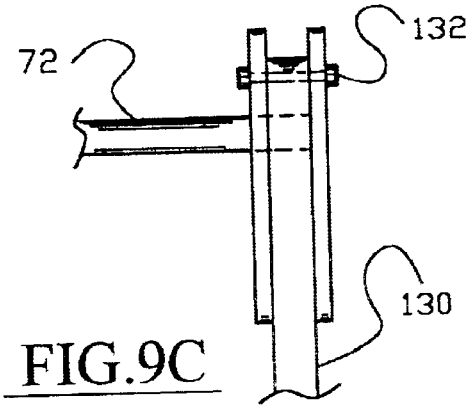
FIG.9C

TOILET SEAT AND COVER SYSTEM

This is a continuation-in-part of U.S. patent application Ser. No. 10/237,294, filed Sep. 9, 2002, now pending, a regular patent application.

The present invention relates to a lever operated toilet seat and cover system.

BACKGROUND OF THE INVENTION

Prior attempts to provide a toilet seat lifting device have involved systems with numerous links, biasing members or cables. For example U.S. Pat. No. 6,189,160 to Pettus discloses a toilet seat lifting device having a lever assembly mounted on a platform that rests on the floor such that depressing a foot pedal downward causes upward movement of a link connected to a lift arm attached to the toilet seat. U.S. Pat. No. 5,487,192 to Hodges, U.S. Pat. No. 5,448,782 to Ratajac, U.S. Pat. No. 5,404,595 to Carmel, and U.S. Pat. No. 5,323,496 to Blair disclose a similar device. U.S. Pat. No. 4,150,446 to Crocker discloses a similar device including a cable which pulls on a lever attached to the toilet seat.

U.S. Pat. No. 4,803,741 to Ellison discloses a toilet seat lifter having a foot actuated lever 20 which is operably connected to the hinged toilet seat 14. The device includes a bracket 16 secured to the top of the toilet bowl 10. The bracket 16 includes a downward turned flange 22 which serves as an attachment point for the fulcrum point 24 of the foot lever 20 (col. 1, lines 63–68), and the fulcrum point 32 for a motion transmitting linkage 26 pivotally mounted at point 32 (col. 2, lines 1–3). The foot lever 20 has a roller 34 (see FIG. 3) mounted on a stud 36 to engage and actuate the underside of arm 28 of linkage 26. The other end 30 of linkage 26 has a roller 38 mounted on a stud extending at right angles to the arm 30 and extending under the toilet seat 14 to elevate the seat when the lever 20 is actuated (col. 2, lines 8–12).

U.S. Pat. No. 6,308,347 to King discloses a toilet seat lifting system having a bracket secured to a toilet seat of a toilet, a vertical member, a lever arm pivotally attached to a lower portion of the vertical member, a pair of support arms attached to an upper portion of the vertical member extending at an angle thereof, an air cylinder attached between the vertical member, and the lever arm, two pulleys rotatably attached to an upper portion of the vertical member, and a length of cord attached to the lever arm extending about the pulleys and attached to bracket (col. 1, lines 58–67). U.S. Pat. No. 6,112,335 to Gaston discloses a similar floor mounted, foot actuated, anti-slamming, toilet seat raising and lowering device which includes a hydraulic device which dampens the descent of the toilet seat to prevent the seat from slamming onto the toilet opening. U.S. Pat. No. 5,327,589 to Rice discloses a similar device except that it includes a pneumatic cylinder assembly to prevent the toilet seat from slamming onto the toilet bowl opening.

U.S. Pat. No. 5,056,165 to Wescott, Sr., discloses a commode flush and seat lift device in which foot pedals are linked to the flush lever 25 and to the toilet seat lid 11 via four conduits 15, 16, 17 and 18 which house the mechanical links between the foot pedals and their respective operable components (col. 3, lines 47–68).

U.S. Pat. No. 5,806,106 to Carter, et al., discloses a hand operated, lever actuated toilet seat lift having three components—namely, a right angle mounting bracket 16, a pivotal seat lifter 18 and a pivotal actuator lever arm 20 (col. 3, lines 14–16). The seat lifter includes a slot 41 which engages a driving pin 46 attached to the lever arm such that movement of the vertical lever arm causes the lifting bracket to move (col. 4, lines 4–11).

U.S. Pat. No. 5,713,084 to Greco discloses a lift mechanism which attaches to the rear edge of a toilet bowl which includes a flexible lever which pivots with regard to the rear edge of the bowl. The flexible lever includes a tang dimensioned such that it can be inserted between the toilet bowl and seat (col. 2, lines 11–16). The lever is may be used to lift the seat by trapping the seat between the tang and a stabilizer located on the lever.

U.S. Pat. No. 5,437,063 to Cotham discloses an automatic toilet seat lifting device having a lever arm 5 with a counter weight 6 attached at the end thereof which acts to raise the toilet seat to a vertical position (col. 3, lines 40–49), after flushing.

None of the prior toilet seat or toilet cover lifting devices are as simple as the present invention. There is a need for a toilet seat and cover system that is simple, self-supportive, durable and easy to maintain.

OBJECTS OF THE INVENTION

It is an object of the present invention to provide a simple toilet seat and cover system which operates using a foot pedal.

It is a further object of the present invention to provide a self-supportive toilet seat and cover system which lifts either the toilet cover, the toilet seat (if the cover is already open), or both the seat and cover.

It is a further object of the present invention to provide a toilet seat and cover system which is easy to maintain sanitary.

SUMMARY OF THE INVENTION

The self-supportive toilet seat and cover system for lifting and placing a toilet seat and cover on an open end of a toilet bowl includes a hinge assembly attached to one end of the toilet bowl opening which also attaches to an end of the toilet seat and toilet cover. The system also includes a first seat lever and first cover lever located on one side of the toilet bowl which are coupled via a second seat lever and a second cover lever, respectively, to respective collars attached to the hinge assembly such that downward pivotal movement of either the first seat lever or first cover lever causes respective second levers to move in a generally downward direction thereby causing rotational movement of the respective cylindrical members of the hinge assembly which are attached to the toilet seat and cover. The rotational movement of the hinge members causes the toilet seat and cover to swing from a substantially horizontal position to a substantially vertical position.

Another embodiment of the self supportive toilet seat and a toilet cover lifting system includes, in combination with the toilet, the toilet seat, toilet cover, a hinge assembly mounted on a distal end of the toilet bowl opening such that the toilet seat and toilet cover may swing about the hinge to a substantially upright position, and a fulcrum located on a lower side of the toilet; a toilet cover assembly having a cover collar mounted to an end of the hinge and a first cover lever having a first end rotatably coupled to the fulcrum and a second end extending proximally therefrom. The system also includes a second cover lever rotatably coupled intermediate the first cover lever and the cover collar such that downward pivotal movement of the first cover lever causes the toilet cover to swing from a substantially horizontal position to a substantially vertical position. The system also includes a toilet seat assembly having a seat collar mounted to the end of the hinge, a first seat lever located adjacent the first cover lever and having a first end rotatably also coupled to the fulcrum; and a second seat lever rotatably coupled intermediate the first seat lever and the seat collar such that downward pivotal movement of the first seat lever causes the toilet seat to swing from a substantially horizontal position to a substantially vertical position.

The system of the present invention may also include a bracket adapted to be attached to the distal end of a toilet such that a portion of the bracket defines the fulcrum at which the toilet seat and toilet cover levers are rotatably coupled. The bracket may include a pivot mount to couple the seat and cover levers, or may include two pivot mounts to couple same at two different locations such that the seat and cover levers are rotatably coupled about both pivot mounts.

The toilet seat and cover system cover collar and seat collar may be structurally defined as a third cover lever and third seat lever, respectively, that are attached to and radiating from the hinge to permit the rotation of the hinge upon force being applied to the second cover and seat levers.

The toilet seat and cover system may also include an extending tab located on the first seat lever such that at least a portion of the tab extends over a portion of the first cover lever such that the downward pivotal movement of the seat lever causes downward pivotal movement of the first cover lever as well.

BRIEF DESCRIPTION OF THE DRAWINGS

Further objects and advantages of the present invention can be found in the detailed description of the preferred embodiments when taken in conjunction with the accompanying drawings in which:

FIG. 6A diagrammatically illustrates a side view of an alternative embodiment of the toilet seat and cover system;

FIG. 6B diagrammatically illustrates a top view of the alternative embodiment of the toilet seat and cover system;

FIG. 6C diagrammatically illustrates a front view of the alternative embodiment of the toilet seat and cover system without the toilet seat and cover;

FIG. 9A diagrammatically illustrates the system with a levered foot pedal coupled to the side of the toilet bowl;

FIG. 9B diagrammatically illustrates a partial view of an alternative lever system using a collar on the hinge system;

FIG. 9C diagrammatically illustrates a side view of the collar of FIG. 9B;

FIG. 10 diagrammatically illustrates a partial view of the levered toilet seat and cover system using a fulcrum bracket having two pivotal mounts; and FIG. 11 diagrammatically illustrates a partial view of the lever system in which the collared hinge defines an arm.

DETAILED DESCRIPTION OF THE PREFERRED EMBODIMENTS

Figure 1:
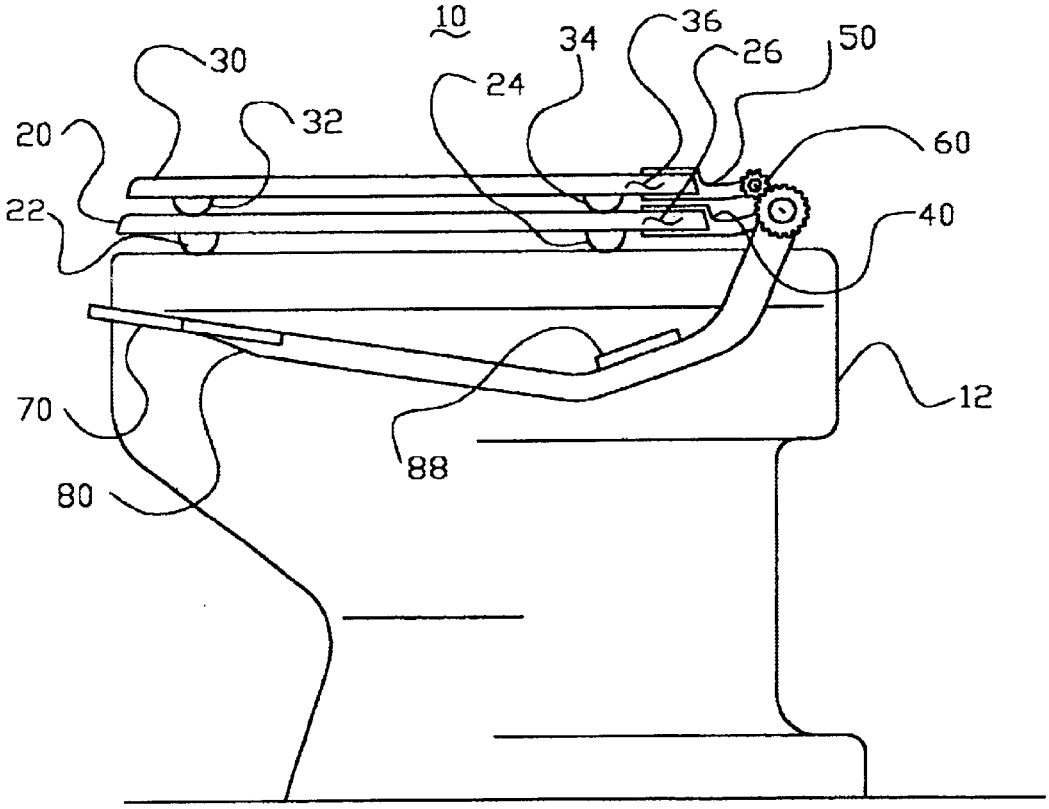
FIG. 1 diagrammatically illustrates a side view the toilet seat and cover system disposed on a toilet bowl.

The present invention relates to a lever operated toilet seat and cover system. FIG. 1 diagrammatically illustrates a side view of the toilet seat and cover system 10 disposed on a toilet bowl 12. The levered toilet seat and cover system 10 is used for lifting and placing a toilet seat 20 and toilet cover 30 disposed on the open end of the toilet bowl 12. The system 10 is designed to be both an after-market device which can be retrofit using a preexisting toilet seat 20 and toilet cover 30, or as a device to replace the preexisting toilet seat and cover. In the latter, the toilet seat 20 and toilet cover 30 may be manufactured as part of the mechanical components which make up the levered toilet seat and cover system 10. Whether manufactured as an after-market device, or as part of the toilet, the system of the present invention is self-supportive. That is, the system 10 is designed to be mounted atop the toilet bowl 12, and in the case of the alternative embodiments, designed to include a fulcrum rotational coupling on the side of the toilet bowl. The side pivotal coupling may also be accomplished viz-a-viz a bracket that extends downwardly from the mounting bracket above the toilet bowl 12. In all embodiments, the system 10 does not require any additional support from the floor or the wall near the toilet. The toilet seat cover 30, the toilet seat 20 and the mechanical components discussed below may be constructed of plastic, fiberglass, stainless steel, anodized aluminum, an aluminum alloy or a combination thereof. Similar items are referenced by the same reference numerals throughout the drawings.

In FIG. 1, toilet seat 20 and toilet cover 30 are substantially planar members as is known in the art. The seat 20 is disposed on the toilet opening via a plurality of spacers 22, 24. Spacers 22, 24 are typically rubber or plastic. However, other suitable materials may be used. The distal end 26 of the seat is attached via bracket 40 to hinge member 60. As used herein, distal refers to the end furthest away from the front side edge of the commode or toilet. Similarly, seat cover 30 is disposed on the toilet seat 20 via a plurality of spacers 32, 34. The spacers are not required, but are customarily used to absorb some of the energy resulting from either the seat 20 or cover 30 being placed in the substantially horizontal position shown in FIG. 1 from a substantially vertical position. The distal end 36 of toilet cover 30 is attached via a second bracket 50 to hinge member 60. Brackets 40, 50 illustrated in FIG. 1 define a channel within which the distal ends 26, 36 of the seat 20 and cover 30 fit, respectively. This embodiment is merely exemplary as other means of securing seat 20 and cover 30 may be employed as known to those skilled in the art. In another embodiment, seat 20 and bracket 40 are manufactured as a single piece. Likewise, cover 30 and respective bracket 50 may be manufactured as a single piece.

As with most toilet seats and toilet covers, toilet seat 20 and toilet cover 30 are capable of radially swinging from a substantially horizontal position (FIG. 1) to a substantially vertical position (FIG. 4) about hinge 60. The system 10 also includes a first lever 70 and a second lever 80 coupled to hinge 60 which are utilized to lift cover 30 and seat 20, respectively.

Figure 2:
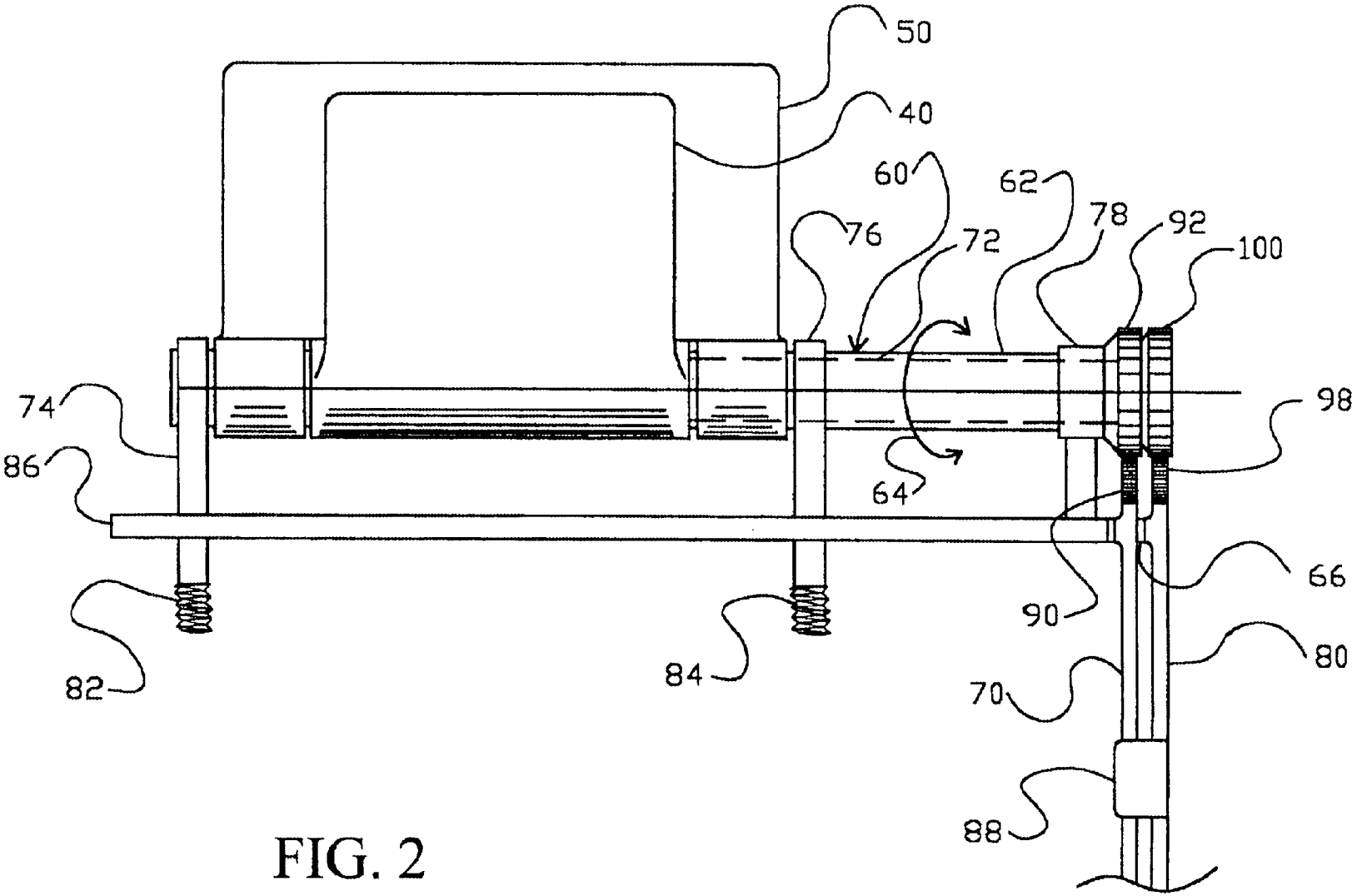
FIG. 2 diagrammatically illustrates a partial perspective view of the toilet seat and cover system.

FIG. 2 diagrammatically illustrates an embodiment of hinge member 60 and its related components. Hinge member 60 includes a rotating member and a stationary member.

The rotating member is, in the illustrated embodiment, two coaxial, substantially cylindrical members 62, 72 supported by stationary support members 74, 76, 78. Cylindrical members 62, 72 rotate about their longitudinal axis as indicated by double-headed arrow 64. The support members 74, 76, 78 are attached to base plate 86. Base plate 86 rests atop bowl 12. The lower portions 82, 84 of support members 74, 76 protrude below base plate 86 and are spaced apart to fit within the holes customarily found on the toilet bowl 12 to affix or fasten the toilet seat and cover. The protruding fastening members 82, 84 include threads which can be used in conjunction with threaded nuts (not shown) to securely fasten the system 10 to the toilet bowl 12.

Figure 3:
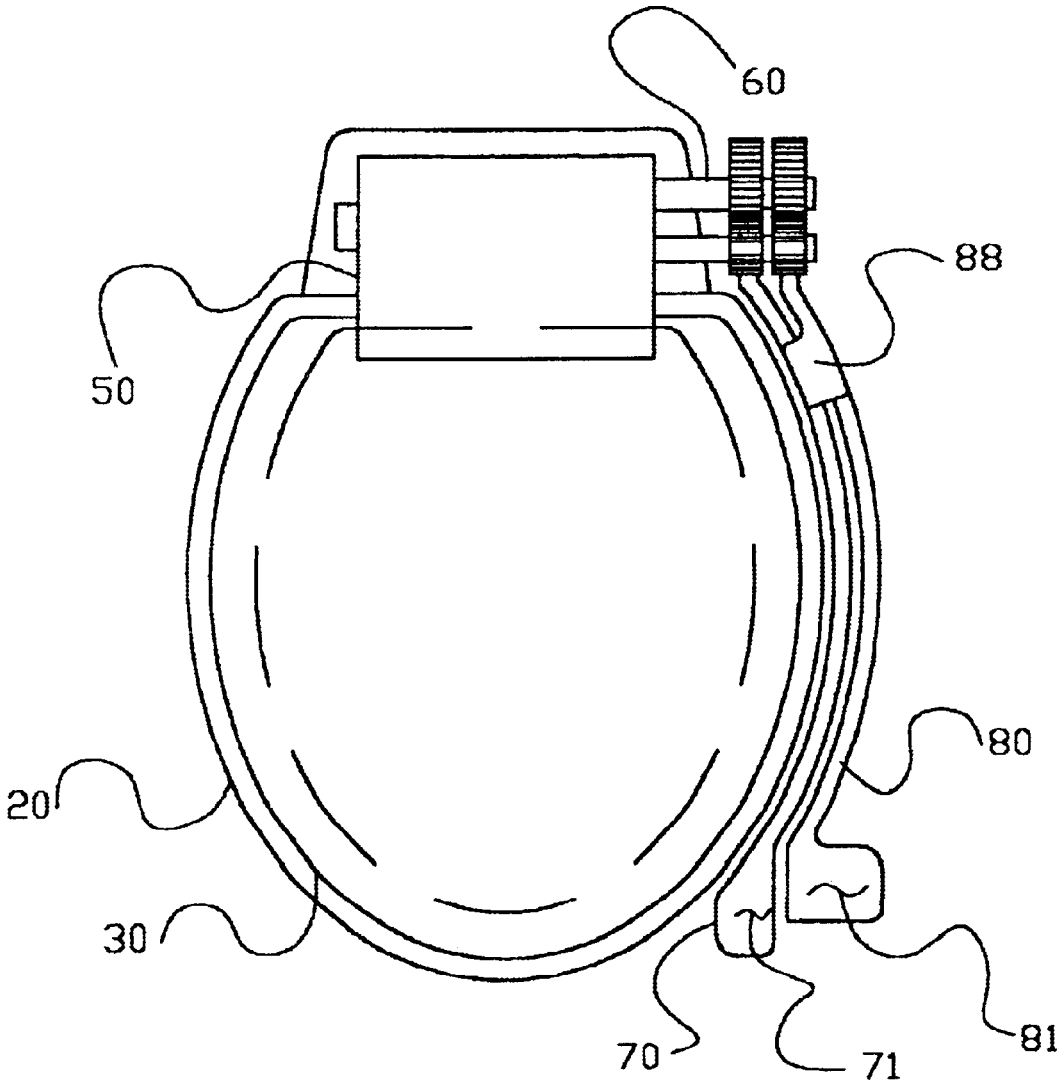
FIG. 3 diagrammatically illustrates a top view of the toilet seat and cover system.
Figure 5:
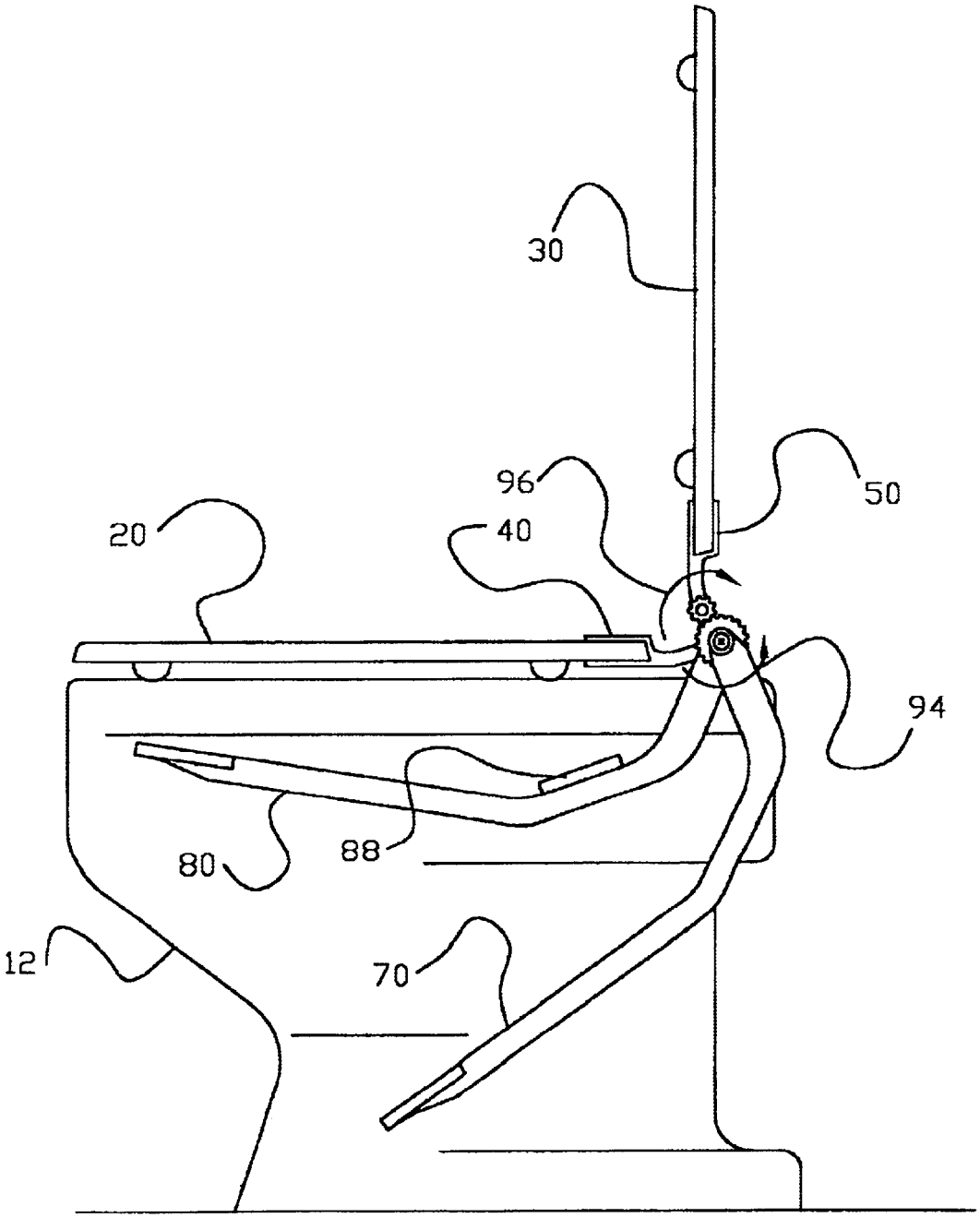
FIG. 5 diagrammatically illustrates a side view the toilet seat and cover system with the toilet cover in a substantially vertical position.

The first lever 70 runs along the side of bowl 12 (see FIG. 3). The proximal end of lever 70 includes foot pedal 71. The distal end of lever 70 is coupled to hinge member 60 via gear 90 (FIG. 2). Lever 70 is also coupled to base plate 86 at fulcrum point 66 which allows radial movement of lever 70 about point 66. Gear 90 meshes with gear 92 located at the end of cylindrical member 62, such that downward radial movement of lever 70 (FIG. 5, arrow 94) causes upward radial movement of bracket 50 and its attached cover 30 (arrow 96).

Figure 4:
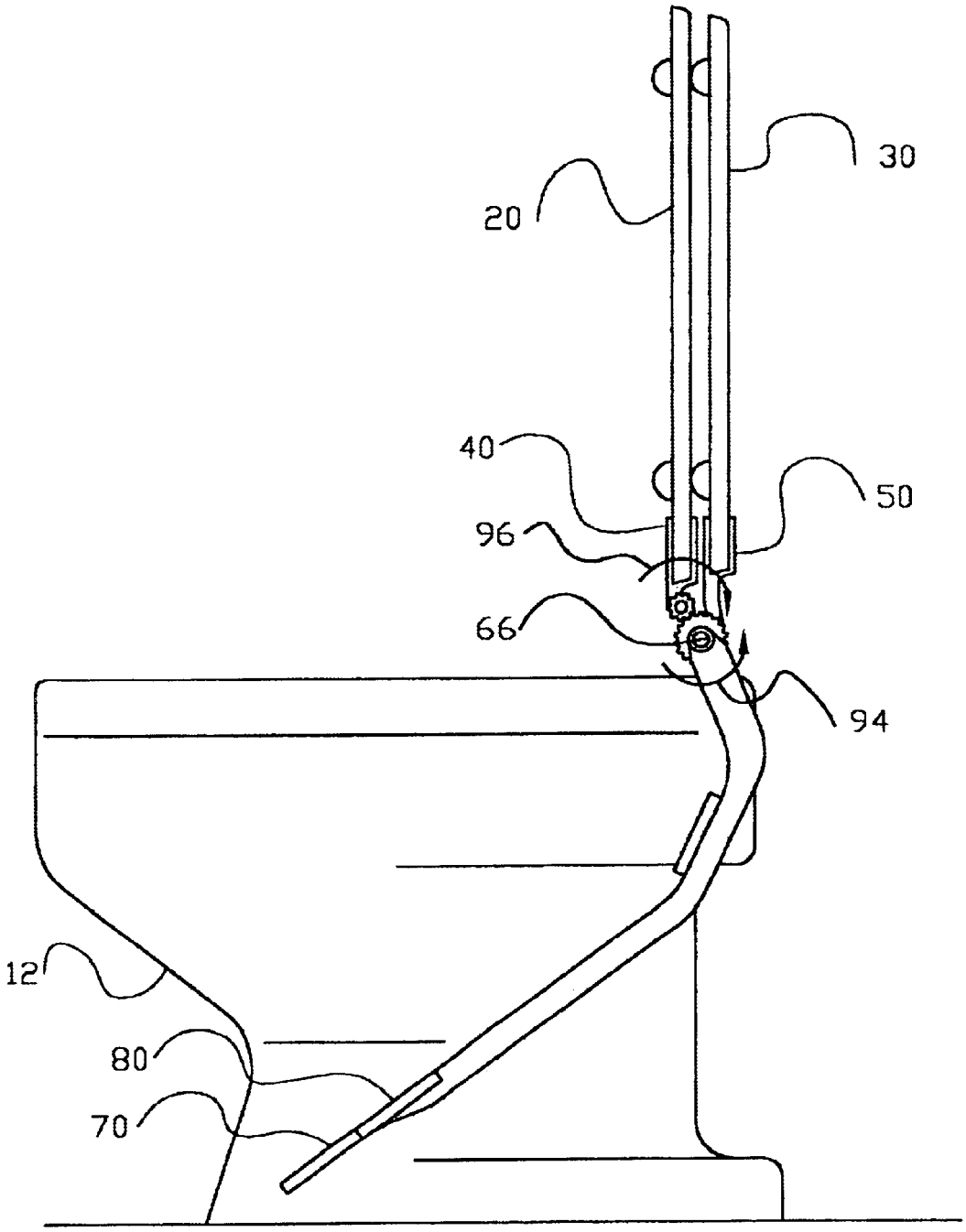
FIG. 4 diagrammatically illustrates a side view the toilet seat and cover system with the toilet seat and cover in a substantially vertical position.

Similarly, second lever 80 runs along the side of bowl 12, adjacent first lever 70. The proximal end of lever 80 also includes a foot pedal 81. The distal end of lever 80 is coupled to hinge member 60 via gear 98. Lever 80 is also coupled to base plate 86 at fulcrum point 66. Gear 98 meshes with gear 100 located at the end of interior cylindrical member 72 which extends beyond the end gear 92 of cylindrical member 62. As illustrated in FIG. 4, downward radial movement of lever 80 (arrow 94) causes upward radial movement of bracket 40 and its attached toilet seat 20 (arrow 96).

The toilet seat and cover system 10 functions as follows. A person wanting to use toilet 12 that does not want to lift the cover 30 or the seat 20 may use his or her foot to have the toilet cover and/or seat move to the upward, lifted position. The person wishing to open only the cover 30 steps on inward lever 70. Lever arm 70 moves radially downward in the counterclockwise direction of arrow 94 (FIGS. 4 and 5) about fulcrum point 66. The movement of gear 90 in direction 94 causes an opposite, clockwise radial movement of gear 92 as indicated by arrow 96. Because cylindrical member 62 is attached to bracket 50 and cover 30, the clockwise radial movement of gear 92 causes the seat cover 30 to move upwardly to a substantially vertical position (see FIG. 5). If the person needed to lift the seat 20, the person need only step on pedal 81 on the second lever 80. Lever arm 80 works similar to lever arm 70. Lever arm 80 moves radially downward in the counterclockwise direction of arrow 94 (FIGS. 4 and 5) about fulcrum point 66. The movement of gear 98 in direction 94 causes an opposite, clockwise radial movement of gear 100 as indicated by arrow 96. Because cylindrical member 72 is attached to bracket 40 and toilet seat 20, the clockwise radial movement of gear 100 causes the toilet seat 20 to move upwardly to a substantially vertical position (see FIG. 4). If the seat cover 30 had been previously on the seat 20 as illustrated in FIGS. 1 and 3, then depression of lever 80 would have caused both the seat 20 and cover 30 to move in an upward manner until both reached a substantially vertical position. Hence the mechanical interaction between gear 98 and 100 would have lifted the weight of both the seat 20 and cover 30.

In one embodiment of the toilet seat and cover system 10, lever 80 includes a tab 88 extending inwardly toward bowl 12 such that the tab overlies a portion of first lever 70. Tab 88 functions as a catch such that downward radial movement of second lever 80 causes downward radial movement of first lever 70. This allows the mechanical force on gears 98 and 100 caused by the weight of the seat 20 and cover 30 to be distributed to gears 90 and 92. In another embodiment (not shown), lever arms 70 and 80 are reversed such that the inward lever arm causes the toilet seat 20 to lift and the outward lever arm causes the toilet cover 30 to lift to a substantially vertical position.

FIGS. 6A, 6B and 6C diagrammatically illustrate an alternative embodiment of the levered toilet seat and cover system 10. These illustrations include bowl 12, tank 14, toilet seat 20, toilet seat cover 30, and the levered system 10. In this alternative embodiment, the toilet seat 20 and toilet cover 30 are similar to the description above in connection with FIG. 1. FIG. 6A illustrates how the downward, pivotal movement of seat lever 80 to its lower position 80' causes toilet seat 20 to move in the direction of arrow 102 from a substantially horizontal position to a substantially vertical position 20'. Note that the displacement d of seat lever 80 is relatively small in comparison to the approximately 90 degree movement of seat 20. FIG. 6B diagrammatically illustrates a top view of an alternative embodiment of the toilet seat and cover system 10 having the levered controls on the right side of the toilet bowl 12. FIG. 6C diagrammatically illustrates a front view of the alternative embodiment of the toilet seat and cover system 10 without the toilet seat and cover.

Figure 7:
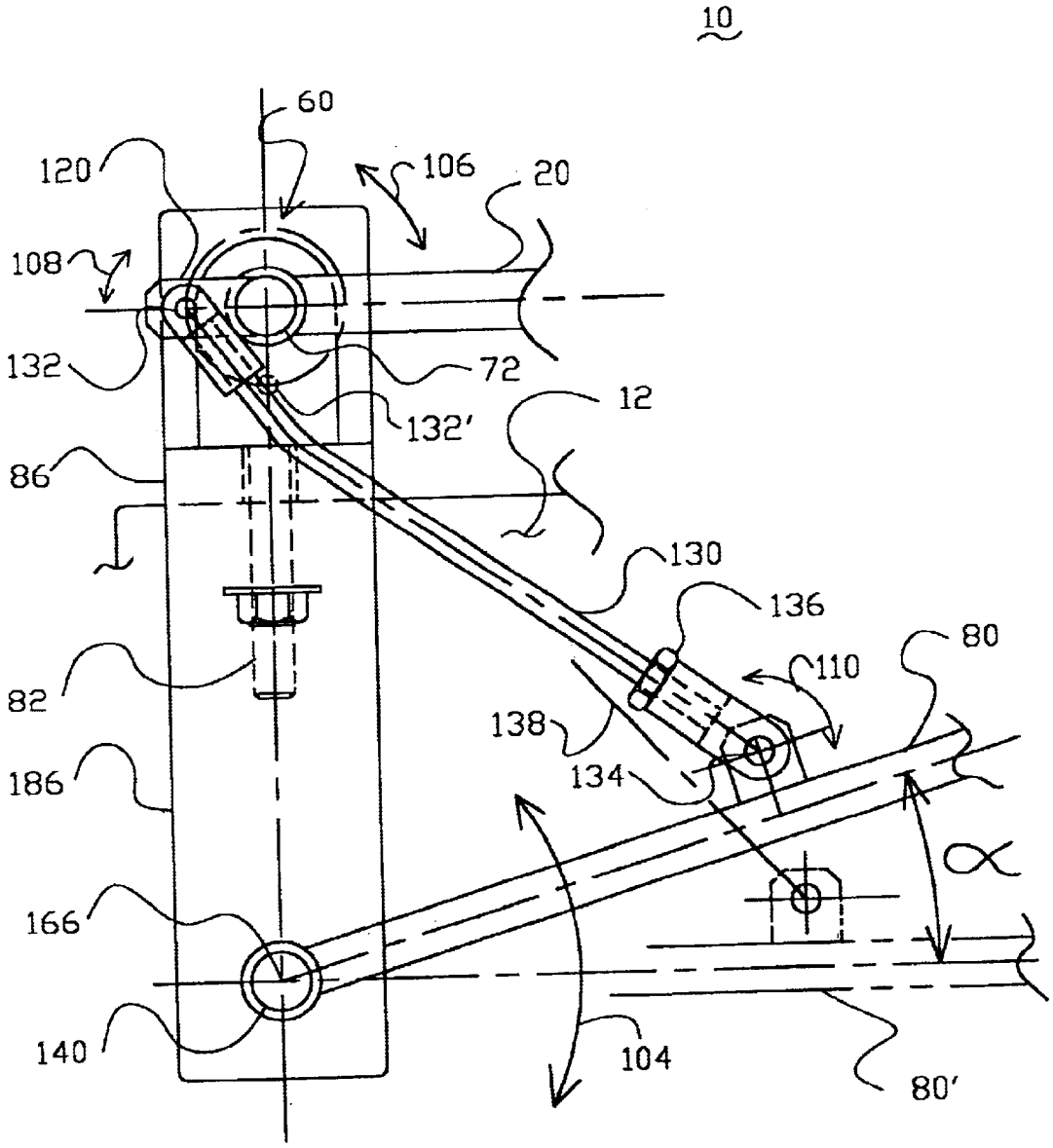
FIG. 7 diagrammatically illustrates a partial view of the levered toilet seat and cover system of the present invention.

FIG. 7 diagrammatically illustrates a partial, side view of the levered toilet seat and cover system 10 located on the side of, and atop, toilet bowl 12. A side view of hinge system 60 illustrates interior cylindrical member 72 having a lever or arm 120 radiating out from the end of cylindrical member 72. Lever or link 120 may also be a collar that extends radially about the entire circumference of member 72 as illustrated in FIG. 9B. For ease of reference, either embodiment, collar or lever arm 120 will be referred to as collar 120. Additionally, because there are two levered assemblies, one for the toilet cover 30 and the other with the toilet seat 20, the components of each assembly will be so designated. Hence, because collar 120 illustrated in FIG. 7 is associated with toilet seat 20, collar 120 will be referred to as seat collar 120. Seat collar 120 is attached to cylindrical member 72 such that when member 72 is rotated as indicated by arrow 106, collar 120 rotates as well.

Seat link or lever 130 is rotatably coupled to collar 120 at joint 132. The coupling may be any connection system which permits rotational movement about joint 132 in the direction of double arrow 108. The other end of seat lever 130 is rotatably coupled to another lever, primary seat lever 80, at joint 134 in a manner permitting rotation as shown by arrow 110. In the embodiment of FIG. 7, seat lever 130 is a substantially rigid member having a length adjustment nut 136. As will be discussed in connection with FIGS. 9A and 10, link 130 may also be a flexible cable. Primary seat lever 80 is rotatably coupled to fulcrum 166 at pivot mount 140. Pivot mount 140 may be a simple pin or shaft and may include bearings. Any connection system which permits rotational movement about fulcrum 166 in the direction of double arrow 104 is suitable. In the illustrated embodiment of FIG. 7, fulcrum 166 is located below hinge system 60, shown from a side view. However, fulcrum 166 may be located elsewhere as shown in FIGS. 10 and 11. Pivot mount 140 is attached to or part of fulcrum bracket 186. Fulcrum bracket 186 may be manufactured as part of the toilet seat and cover system 10 or may be a separate component attached to the toilet as a retrofit kit. Additionally, the fulcrum pivot mount 140 may be manufactured as part of the toilet bowl 12 as shown in FIG. 9A. The other, proximal end of primary seat lever 80 (not shown in FIG. 7) provides the pedal to operate the system as described in connection with FIGS. 1 through 5.

Figure 8:
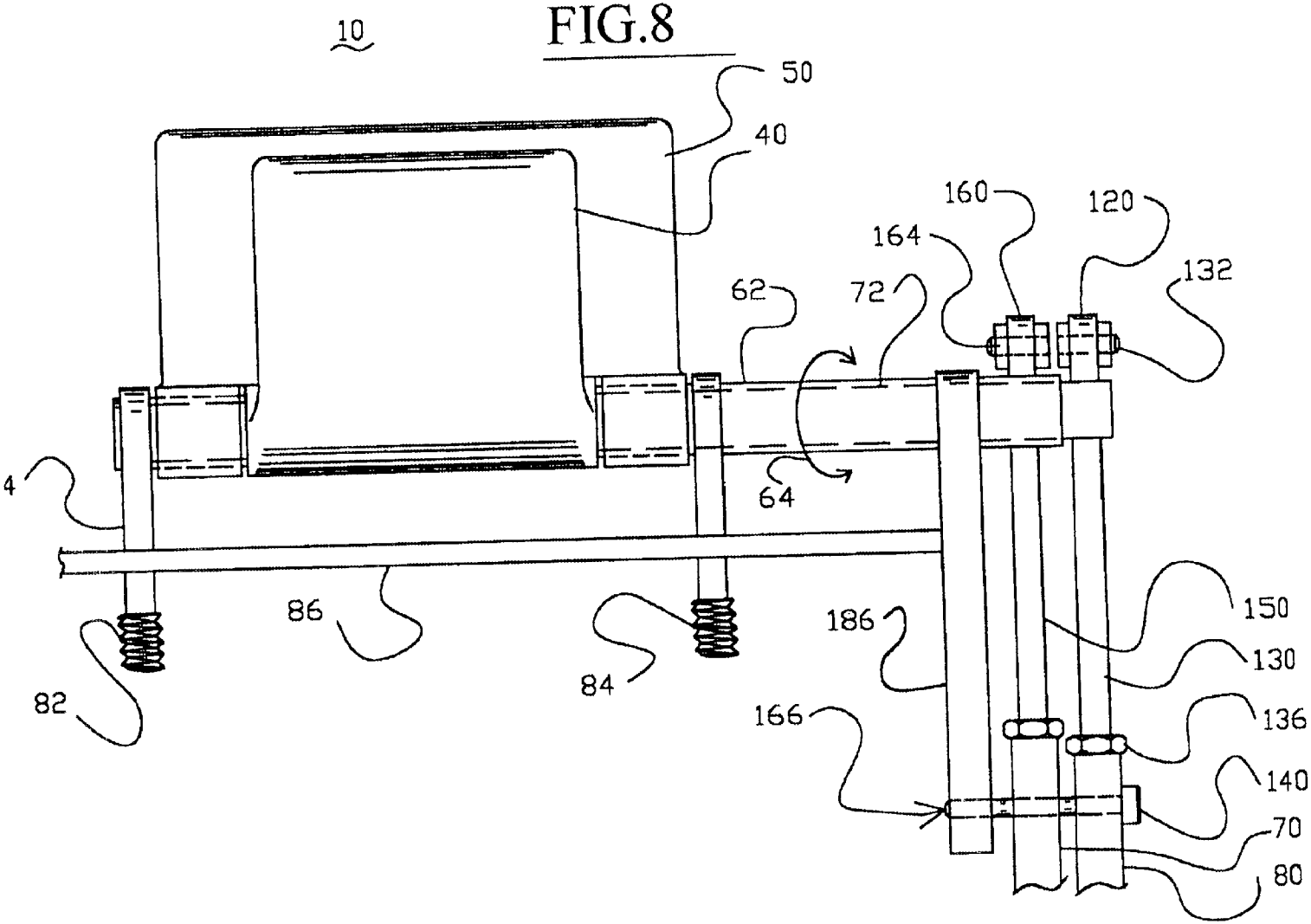
FIG. 8 diagrammatically illustrates a partial perspective view of an alternative levered toilet seat and cover system.

FIG. 7 diagrammatically illustrates the toilet seat assembly necessary to cause the toilet seat 20 to lift. Similar components are used to operate toilet cover 30. FIG. 8 diagrammatically illustrates a partial perspective view of the levered toilet seat and cover system 10 including both levered assemblies. In FIG. 8, primary seat lever 80 is to the right of primary cover lever 70. Both, primary seat lever 80 and primary cover lever 70 are rotatably coupled to fulcrum 166 at pivot mount 140. Primary cover lever 70 is rotatably coupled to a second cover lever or link 150. Second cover lever 150 is rotatably coupled to collar 160 at joint 164. Collar 160, illustrated as an arm or protruding member in FIG. 8, is attached to cylindrical cover member 62 such that rotation of cylindrical member 62 causes rotation of cover arm 160.

The toilet seat and toilet cover lift system 10 illustrated in FIGS. 6A through 8 functions as follows. The person utilizing the toilet and the lift system 10 places his or her foot on the end of seat lever 80 (FIG. 6A), causing a downward, pivotal rotation of lever 80 about fulcrum 166. The downward movement of primary lever 80 causes seat lever or link 130 to move in a generally downward direction to a position shown by dashed line 138 in FIG. 7. During the downward pivotal movement of seat lever 80 through angle $\alpha$, the downward motion of link 130 causes a counterclockwise rotation of collar 120 (FIG. 7) such that rotation joint 132 undergoes an approximately 90 degree shift, finally reaching position 132'. The counterclockwise rotation of collar 120 causes inner cylindrical member 72 to rotate approximately 90 degrees, thereby lifting the attached toilet seat 20 to a substantially vertical position. The operation of the cover lever assembly is the same.

FIG. 9A diagrammatically illustrates the toilet seat and cover lift system 10 with the primary seat and cover levers 70, 80 rotatably coupled to the side of the toilet bowl 12 at fulcrum 166. In the embodiment illustrated in FIG. 9A, the pivot mount 140 is part of the toilet bowl 12.

FIG. 9B diagrammatically illustrates a partial view of an alternative embodiment of the lever system using a collar 120 on the hinge system 60. As described above in connection with FIG. 7, collar 120 is rotatably coupled to seat link 130 at joint 132. FIG. 9C diagrammatically illustrates the rotatable coupling of seat link 130 to collar 120 from the perspective of line 9C'-9C". Using the type of collar 120 illustrated in FIG. 9C, seat link 130 may be a flexible cable. Accordingly, cable link 130 wraps around collar 130 similar to a pulley system.

FIG. 10 diagrammatically illustrates a partial view of the levered toilet seat and cover system 10 using a fulcrum bracket 186 having two pivotal mounts 140, 142. In this embodiment, each of the primary seat and cover levers 70, 80 are coupled via secondary seat and cover cable links 150, 130, to seat and cover collars 160, 120, respectively (collar 160 not shown). FIG. 11 diagrammatically illustrates a partial view of the lever system 10 in which the collared hinge defines an arm 120. In the embodiment of FIG. 11, the fulcrum 166 is located downward and distal of the assembly 60.

The claims appended hereto are meant to cover modifications and changes within the scope and spirit of the present invention.

What is claimed is:

1. In combination with a toilet, a toilet seat and a toilet cover, a system for lifting and placing said toilet seat, and said cover, on an open end of a toilet bowl, said toilet seat being a substantially planar toilet seat rotatably mounted on a distal end of said toilet bowl via a first member of a hinge, said toilet seat capable of swinging about said hinge to a substantially upright position; said toilet cover being a substantially planar toilet cover disposed on said toilet seat and coupled to a second coaxial member of said hinge, said toilet cover capable of swinging in a substantially upright position; said toilet having a fulcrum located on a lower side of said toilet; the lift system comprising:

a toilet cover assembly having a cover collar mounted to an end of said first member of said hinge;

a first cover lever having a first end rotatably coupled to said fulcrum and a second end extending proximally therefrom;

a second cover lever rotatably coupled intermediate said first cover lever and said cover collar such that downward pivotal movement of said first cover lever causes said toilet cover to swing from a substantially horizontal position to said substantially vertical position;

a toilet seat assembly having a seat collar mounted to an end of said second coaxial member of said hinge;

a first seat lever located adjacent said first cover lever and having a first end rotatably coupled to said fulcrum;

a second seat lever rotatably coupled intermediate said first seat lever and said seat collar such that downward pivotal movement of said first seat lever causes said toilet seat to swing from a substantially horizontal position to said substantially vertical position; and a bracket having a portion attached to said distal end of said toilet and another portion extending downwardly such that said downwardly extending portion of said bracket defines said fulcrum.

2. A toilet seat and cover system as claimed in claim 1 wherein said bracket includes a pivot mount at said fulcrum such that said first cover lever and said first seat lever are rotatably coupled about said pivot mount.

3. A toilet seat and cover system as claimed in claim 1 wherein said bracket includes two pivot mounts at said fulcrum such that said first cover lever is rotatably coupled about one of said pivot mounts and said first seat lever is rotatably coupled about said other pivot mount.

4. A toilet seat and cover system as claimed in claim 1 wherein said first seat lever includes a tab extending over a portion of said first cover lever such that said downward pivotal movement of said seat lever causes downward pivotal movement of said first cover lever.

5. A toilet seat and cover system as claimed in claim 1 wherein said toilet seat and toilet cover assemblies are made of a material from the group of stainless steel, plastic, fiberglass and aluminum alloy.

6. In combination with a toilet, a toilet seat and a toilet cover, a toilet seat and cover system for lifting and placing a substantially planar toilet seat and toilet cover on an open end of a toilet bowl, said toilet seat being disposed on said toilet bowl and said toilet cover being disposed on said toilet seat, the system comprising:

a seat bracket secured to an end of said toilet seat;

a cover bracket secured to an end of said toilet cover;

a hinge partly mounted to a distal end of said toilet bowl and partly coupled to said seat and cover brackets such that said brackets are hingedly attached to said toilet bowl; said hinge having a first member and a second coaxial member, said seat bracket secured to said first member and allowing said toilet seat to swing to a substantially vertical position, said cover bracket secured to said second member and allowing said toilet cover to swing to a substantially vertical position, a fulcrum bracket having a portion attached to said distal end of said toilet and another portion extending downwardly such that said downwardly extending portion of said bracket defines a fulcrum;

a seat collar coupled to an end of said second coaxial member of said hinge a cover lever located on one side of said toilet bowl and rotatably coupled to said fulcrum;

a substantially rigid cover link rotatably coupled to said cover lever and said hinge in a said cover collar such that downward pivotal movement of said cover lever causes said toilet cover to swing from a substantially horizontal position to said substantially vertical position;

a seat collar coupled to an end of said second coaxial member of said hinge;

a seat lever located adjacent said cover lever and rotatably coupled to said fulcrum; and a substantially rigid seat link rotatably coupled to said seat lever and said hinge in a said seat collar such that downward pivotal movement of said seat lever causes said toilet seat to swing from a substantially horizontal position to a substantially vertical position.

7. A toilet seat and cover system as claimed in claim 6 wherein said fulcrum bracket includes a pivot mount located substantially below said hinge such that said cover lever and said seat lever are rotatably coupled about said pivot mount.

8. A toilet seat and cover system as claimed in claim 6 wherein said fulcrum bracket includes two pivot mounts located substantially below said hinge such that said cover lever is rotatably coupled about one of said pivot mounts and said seat lever is rotatably coupled about said other pivot mount.

9. A toilet seat and cover system as claimed in claim 6 wherein said seat lever includes a tab extending over a portion of said cover lever such that said downward pivotal movement of said seat lever causes downward pivotal movement of said first cover lever.

* * * * *